US011346545B2

(12) United States Patent
Huber et al.

(10) Patent No.: US 11,346,545 B2
(45) **Date of Patent: *May 31, 2022**

(54) SPRAY HEADS FOR USE WITH DESUPERHEATERS AND DESUPERHEATERS INCLUDING SUCH SPRAY HEADS

(71) Applicant: FISHER CONTROLS INTERNATIONAL LLC, Marshalltown, IA (US)

(72) Inventors: Marc Huber, Windisch (CH); Kaspar Löffel, Windisch (CH); Thomas Duda, Baar (CH)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 127 days.

This patent is subject to a terminal disclaimer.

(21) Appl. No.: 16/185,627

(22) Filed: Nov. 9, 2018

(65) Prior Publication Data

US 2020/0149737 A1 May 14, 2020

(51) Int. Cl.

| | |
|---|---|
| ***F22G 5/12*** | (2006.01) |
| ***B05B 7/06*** | (2006.01) |
| ***B05B 7/04*** | (2006.01) |

(52) U.S. Cl.

CPC ..... *F22G 5/123* (2013.01); *B05B 7/04* (2013.01); *B05B 7/0458* (2013.01); *B05B 7/06* (2013.01); *F22G 5/12* (2013.01)

(58) Field of Classification Search

CPC ..... B05B 7/06; B05B 7/04; B05B 7/0458; F22G 5/12; F22G 5/123

(Continued)

(56) References Cited

U.S. PATENT DOCUMENTS

| | | | |
|---|---|---|---|
| 3,524,592 | A | 8/1970 | Gustafsson |
| 4,130,611 | A | 12/1978 | Brand |

(Continued)

FOREIGN PATENT DOCUMENTS

| | | |
|---|---|---|
| AT | 400616 B | 2/1996 |
| AT | 404176 B | 9/1998 |

(Continued)

OTHER PUBLICATIONS

International Search Report and Written Opinion for PCT/US2019/059958, dated Apr. 24, 2020.

(Continued)

*Primary Examiner* — Steven J Ganey

(74) *Attorney, Agent, or Firm* — Marshall, Gerstein & Borun LLP

(57) ABSTRACT

Spray heads for use with desuperheaters and desuperheaters including such spray heads. One example of a spray head includes a main body having an exterior surface and defining a central passage, the main body adapted for connection to a source of fluid, at least one entrance port formed in the main body along the central passage, and at least one spray nozzle arranged adjacent the exterior surface of the main body. The spray head also includes a plurality of flow passages, each of the plurality of flow passages providing fluid communication between the entrance port and an exit opening of the spray nozzle. A first one of the plurality of flow passages follows a first non-linear path and has a first distance, and a second one of the plurality of flow passages follows a second non-linear path and has a second distance different from the first distance.

22 Claims, 9 Drawing Sheets

(58) Field of Classification Search
USPC ..... 239/423, 424, 433, 434; 261/27, 116, 261/118; 122/487
See application file for complete search history.

(56) References Cited

U.S. PATENT DOCUMENTS

| | | | | |
|---|---|---|---|---|
| 4,442,047 | A | 4/1984 | Johnson | |
| 4,909,445 | A | 3/1990 | Schoonover | |
| 5,290,486 | A * | 3/1994 | Enarson | B01F 5/045 261/116 |
| 5,439,619 | A | 8/1995 | Kuffer | |
| 5,607,626 | A * | 3/1997 | Kunkle | F22G 5/123 261/116 |
| 6,746,001 | B1 | 6/2004 | Sherikar | |
| 8,333,329 | B2 | 12/2012 | Ignatan et al. | |
| 9,492,829 | B2 | 11/2016 | Mastrovito | |
| 10,443,837 | B2 | 10/2019 | Strebe | |
| 2009/0174087 | A1 | 7/2009 | Bauer | |
| 2009/0256007 | A1 | 10/2009 | McMasters et al. | |
| 2012/0017852 | A1* | 1/2012 | Geelhart | B05B 7/0075 122/487 |
| 2016/0033124 | A1 | 2/2016 | Giove et al. | |
| 2020/0149737 | A1 | 5/2020 | Huber et al. | |
| 2020/0173652 | A1 | 6/2020 | Huber et al. | |

FOREIGN PATENT DOCUMENTS

| | | | | |
|---|---|---|---|---|
| DE | 3415086 | C1 | 11/1985 | |
| DE | 198 30 244 | C2 | 5/2000 | |
| DE | 202010009860 | U1 | 10/2011 | |
| EP | 0 481 573 | A1 | 4/1992 | |
| EP | 0481573 | A1 | 4/1992 | |
| EP | 0 971 168 | A2 | 1/2000 | |
| EP | 0971168 | A2 * | 1/2000 | F22G 5/123 |
| EP | 1 965 132 | A1 | 9/2008 | |
| EP | 1965132 | A1 | 9/2008 | |
| EP | 2 405 195 | A2 | 1/2012 | |
| EP | 2405195 | A2 | 1/2012 | |
| JP | 2015-190757 | A | 11/2015 | |
| JP | 2015190757 | A | 11/2015 | |
| KR | 19980023165 | U | 7/1998 | |
| NL | 9201491 | A | 3/1994 | |
| NL | 9301125 | A | 1/1995 | |
| WO | WO-83/03365 | A1 | 10/1983 | |
| WO | WO-98/08025 | A1 | 2/1998 | |

OTHER PUBLICATIONS

Huber, "Additively Manufactured Sprayhead for a Desuperheater," Master of Science in Engineering. Publically available May 2019.

* cited by examiner

SPRAY HEADS FOR USE WITH DESUPERHEATERS AND DESUPERHEATERS INCLUDING SUCH SPRAY HEADS

FIELD OF THE DISCLOSURE

The present patent relates generally to spray heads and, in particular, to spray heads for use with desuperheaters and desuperheaters including such spray heads.

BACKGROUND

Steam supply systems typically produce or generate superheated steam having relatively high temperatures (e.g., temperatures greater than the saturation temperatures) greater than maximum allowable operating temperatures of downstream equipment. In some instances, superheated steam having a temperature greater than the maximum allowable operating temperature of the downstream equipment may damage the downstream equipment.

Thus, a steam supply system typically employs a desuperheater to reduce the temperature of the steam downstream from the desuperheater. Some known desuperheaters (e.g., insertion-style desuperheaters) include a body portion that is suspended or disposed substantially perpendicular to a fluid flow path of the steam flowing in a passageway (e.g., a pipeline). The desuperheater includes a spray head having a nozzle that injects or sprays cooling water into the steam flow to reduce the temperature of the steam flowing downstream from the desuperheater.

FIG. 1 illustrates one example of a known desuperheater 104 coupled to a flow line 102 through which steam flows. The desuperheater 104 is coupled to the flow line 102 via a flanged connection 105 including opposing flanges 106, 107. As shown, the desuperheater 104 includes a desuperheater body 110 and a spray head 108 coupled to the desuperheater body 110 and having a nozzle 112 extending from the desuperheater body 110. It will be appreciated that each of these parts of the desuperheater 104 are separately produced using conventional manufacturing techniques and then assembled together.

To decrease the temperature of the steam within the flow line 102, the nozzle 112 of the desuperheater 104 is positioned to emit spray water 114 into the flow line 102 via a linear flow passage that provides fluid communication between (i) a port formed in the spray head 108 and adapted for connection to a source of spray water and (ii) the nozzle 112. In operation, a temperature sensor 116 provides temperature values of the steam within the flow line 102 to a controller 118. The controller 118 is coupled to a control valve assembly 120 including an actuator 122 and a valve 124. When the temperature value of the steam within the flow line 102 is greater than a set point, the controller 118 causes the actuator 122 to open the valve 124 to enable the spray water 114 to flow through the control valve assembly 120, to and out of the nozzle 112, and into the flow line 102.

SUMMARY

In accordance with a first aspect of the present disclosure, a spray head for a desuperheater is provided. The spray head includes a main body having an exterior surface and defining a central passage that extends along a longitudinal axis, the main body adapted for connection to a source of fluid. The spray head also includes at least one entrance port formed in the main body along the central passage. The spray head further includes at least one spray nozzle arranged adjacent the exterior surface of the main body, the spray nozzle having at least one exit opening and a plurality of flow passages, each of the plurality of flow passages providing fluid communication between the entrance port and the exit opening of the spray nozzle, wherein a first one of the plurality of flow passages follows a first non-linear path and has a first distance, and wherein a second one of the plurality of flow passages follows a second non-linear path and has a second distance different from the first distance.

In accordance with a second aspect of the present disclosure, a desuperheater is provided. The desuperheater includes a desuperheater body and a spray head coupled to the desuperheater body. The spray head includes a main body having an exterior surface and defining a central passage that extends along a longitudinal axis, the main body adapted for connection to a source of fluid. The spray head also includes at least one entrance port formed in the main body along the central passage. The spray head further includes at least one spray nozzle arranged adjacent the exterior surface of the main body, the spray nozzle having at least one exit opening and a plurality of flow passages, each of the plurality of flow passages providing fluid communication between the entrance port and the exit opening of the spray nozzle, wherein a first one of the plurality of flow passages follows a first non-linear path and has a first distance, and wherein a second one of the plurality of flow passages follows a second non-linear path and has a second distance different from the first distance.

In accordance with a third aspect of the present disclosure, a method of manufacturing is provided. The method includes creating a spray head for a desuperheater using an additive manufacturing technique. The act of creating includes forming a main body of the spray head having an exterior surface and defining a central passage that extends along a longitudinal axis, the main body adapted for connection to a source of fluid. The act of creating also includes forming at least one entrance port in the main body along the central passage. The act of creating further includes forming at least one spray nozzle arranged adjacent the exterior surface of the main body, the spray nozzle having at least one exit opening and forming a plurality of flow passages that provide fluid communication between the entrance port and the exit opening of the spray nozzle, wherein a first one of the plurality of flow passages follows a first non-linear path and has a first distance, and wherein a second one of the plurality of flow passages follows a second non-linear path and has a second distance different from the first distance.

In further accordance with the foregoing first, second and/or third aspects, an apparatus and/or method may further include any one or more of the following preferred forms.

In one preferred form, the first non-linear path includes a first convoluted path and wherein the second non-linear path includes a second convoluted path.

In another preferred form, the first flow passage has a first variable cross-section and the second flow passage has a second variable cross-section.

In another preferred form, the fluid exiting the exit opening via the first flow passage has a first pressure, and the fluid exiting the exit opening via the second flow passage has a second pressure that differs from the first pressure when an inlet of the second flow passage is not fully open.

In another preferred form, the main body and the spray nozzle are integrally formed with one another.

In another preferred form, the spray nozzle includes a single chamber disposed between and fluidly connecting each of the flow passages and the exit opening of the spray nozzle. Each of the flow passages may have an outlet that feeds into the single chamber, such that the flow passages are independently coupled to the single chamber.

In another preferred form, the first flow passage has a portion that is parallel to the longitudinal axis of the body.

In another preferred form, the entrance port is positioned adjacent a first end of the main body, the first flow passage has an inlet in fluid communication with the entrance port, and an outlet in fluid communication with the exit opening of the spray nozzle, the outlet positioned adjacent a second end of the main body.

In another preferred form, the spray nozzle includes a first chamber and a second chamber. The first chamber may be disposed between and fluidly connect the first flow passage and the exit opening of the spray nozzle. The second chamber may be disposed between and fluidly connect the second flow passage and the exit opening of the spray nozzle. The first and second chambers may be concentrically arranged.

In another preferred form, the first flow passage has a first inlet that fluidly connects the entrance port with the exit opening, and the second flow passage has a second inlet that fluidly connects the entrance port with the exit opening, the second inlet being separate from the first inlet.

In another preferred form, the spray head includes first and second entrance ports, wherein the first entrance port is spaced from the second entrance port along the longitudinal axis.

In another preferred form, a plug is movably disposed within the main body of the spray head to control fluid flow through the entrance port and out of the spray head.

In another preferred form, the first flow passage has a first variable cross-section and the second flow passage has a second variable cross-section, such that the fluid exiting the exit opening via the first flow passage has a first pressure, and the fluid exiting the exit opening via the second flow passage has a second pressure that differs from the first pressure when an inlet of the second flow passage is not fully open.

In another preferred form, the spray nozzle includes a single chamber disposed between and fluidly connecting each of the flow passages and the exit opening of the spray nozzle, wherein each of the flow passages has an outlet that feeds into the single chamber, such that the flow passages are independently coupled to the single chamber.

DETAILED DESCRIPTION

Although the following text discloses a detailed description of example methods, apparatus and/or articles of manufacture, it should be understood that the legal scope of the property right is defined by the words of the claims set forth at the end of this patent. Accordingly, the following detailed description is to be construed as examples only and does not describe every possible example, as describing every possible example would be impractical, if not impossible. Numerous alternative examples could be implemented, using either current technology or technology developed after the filing date of this patent. It is envisioned that such alternative examples would still fall within the scope of the claims.

The examples disclosed herein relate to spray heads for use with desuperheaters that can be custom produced, using cutting edge manufacturing techniques like additive manufacturing, as a single part that satisfies customer specific designs with less process efforts (e.g., without brazing and other conventional, time intensive manufacturing techniques) and at a cheaper cost as compared to some known spray heads. The spray heads disclosed herein can, for example, be produced with nozzles having any number of customized flow passages having any number of different complex geometries that decrease the footprint of the spray head (or at least decrease the amount of space used by the flow passages), reduce leakage, increase the quality of the discharged atomized fluid (e.g., the spray water) and increase the controllability of the spray heads. As an example, the nozzles can be produced having flow passages with a non-uniform cross-section, thereby reducing pressure loss as the fluid to be atomized flows from the main body of the spray head and out through the nozzle(s) of the spray head via the flow passages. As another example, the nozzles can be produced with independently controllable inlets and one or more chambers (which themselves may be independent from one another). As a result of providing independently inlets, the pressure of each of the inlets can be independently controlled based on, for example, the geometry (e.g., cross-sections) of the different flow passages, when the inlet is not fully opened (i.e., the inlet is only "partially opened"). Put another way, flow characteristics of the fluid flowing through the inlets can be similar to or different from one another based on how the flow passages are structured. For example, a first one of the flow passages can have a geometry that provides fluid at a first pressure to an exit opening of the nozzle and a second one of the flow passages can be structured to provide fluid at a second pressure to the exit opening of the nozzle (the second pressure may be different than the first pressure when one of the inlets of the nozzle is partially opened).

Figure 1:
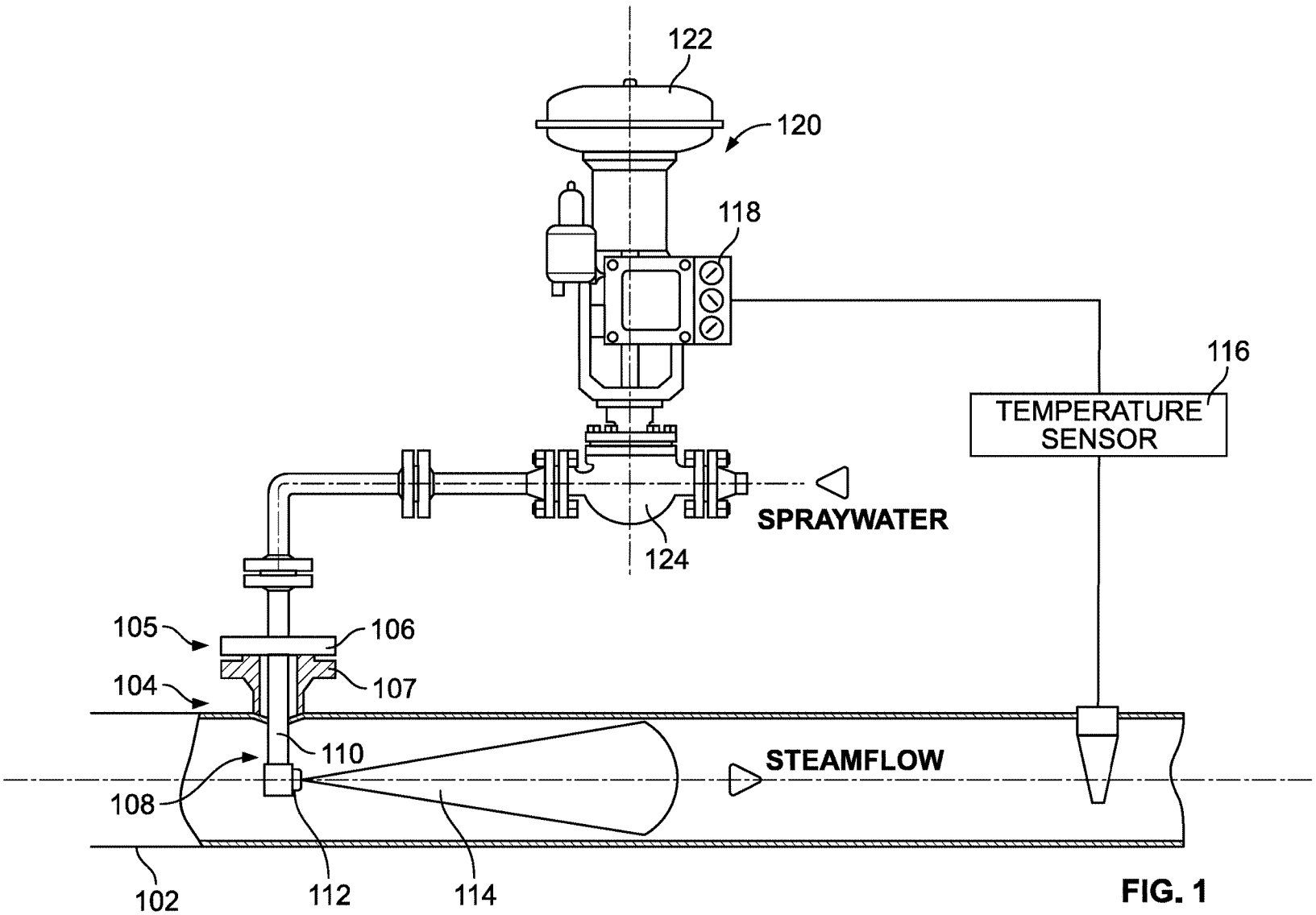
FIG. 1 (PRIOR ART)
FIG. 1 illustrates a known desuperheater coupled to a flow line through which steam flows.

FIGS. 2-5 illustrate one example of a spray head 200 for a desuperheater that is constructed in accordance with the teachings of the present disclosure. As discussed herein, the spray head 200 is used in the desuperheater 104 in place of the spray head 108 of FIG. 1, though it will be appreciated that the spray head 200 can be used in other desuperheaters (or in connection with other flow lines). In the illustrated example, the spray head 200 is formed of a main body 204, a plurality of entrance ports 208 formed in the main body 204, and a plurality of spray nozzles 212A-212J having a plurality of flow passages 216A-216J, with each of these components integrally formed with one another to form a unitary spray head. In other examples, however, the spray head 200 can vary. As an example, the spray head 200 can instead include a different number of entrance ports 208 (e.g., only one entrance port 208) and/or a different number of spray nozzles.

The main body 204 is generally adapted to be connected to a source of fluid (not shown) for reducing the temperature of the steam flowing through the line 102 (or any other similar line). The main body 204 has a first end 220 and a second end 224 opposite the first end 220. Between the first end 220 and the second end 224, the main body 204 includes a collar 228 arranged at or proximate the first end 220 and an elongated portion 236 arranged between the collar 220 and the second end 224. The collar 228 is generally arranged to be coupled to the flange 106 when the spray head 200 is used in the desuperheater 104. The collar 228 can, but need not, include threads for threadably engaging the flange 106. Meanwhile, at least a substantial portion of the elongated portion 236 is arranged to be positioned within the flow line 102 when the spray head 200 is used in the desuperheater 104. The main body 204 also includes an outer wall 237 (partially removed in FIGS. 3-5 in order to illustrate other features of the spray head 200) and an inner wall 238 spaced radially inwardly of the outer wall 237. The inner wall 238 defines a central passage 240 that extends along a longitudinal axis 244 of the main body 204 between the first and second ends 220, 224.

Figure 3:
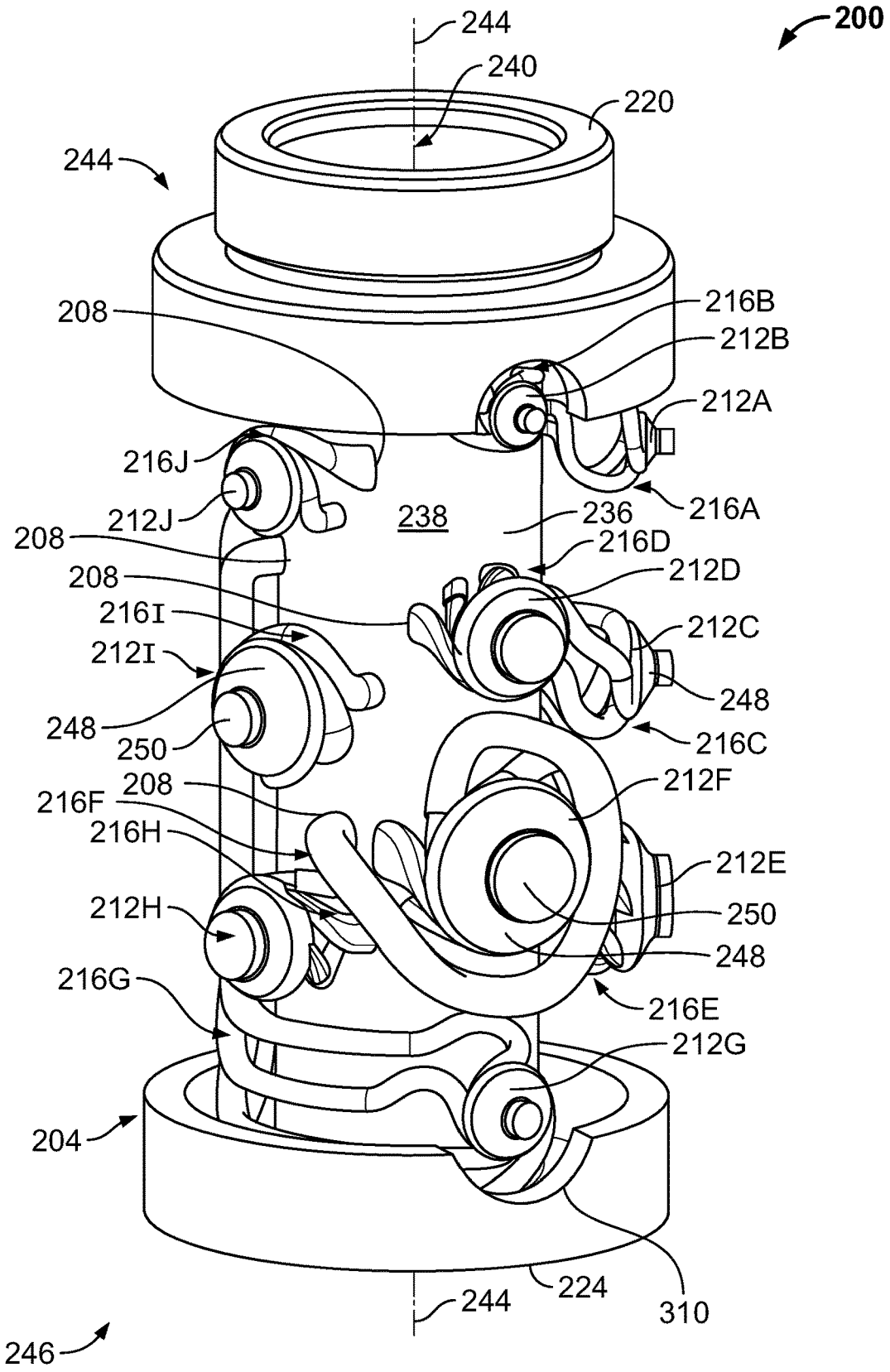
FIG. 3 is similar to FIG. 2, but with a portion of the spray head removed and hollow components of the spray head shown in outline for illustrative purposes.
Figure 4:
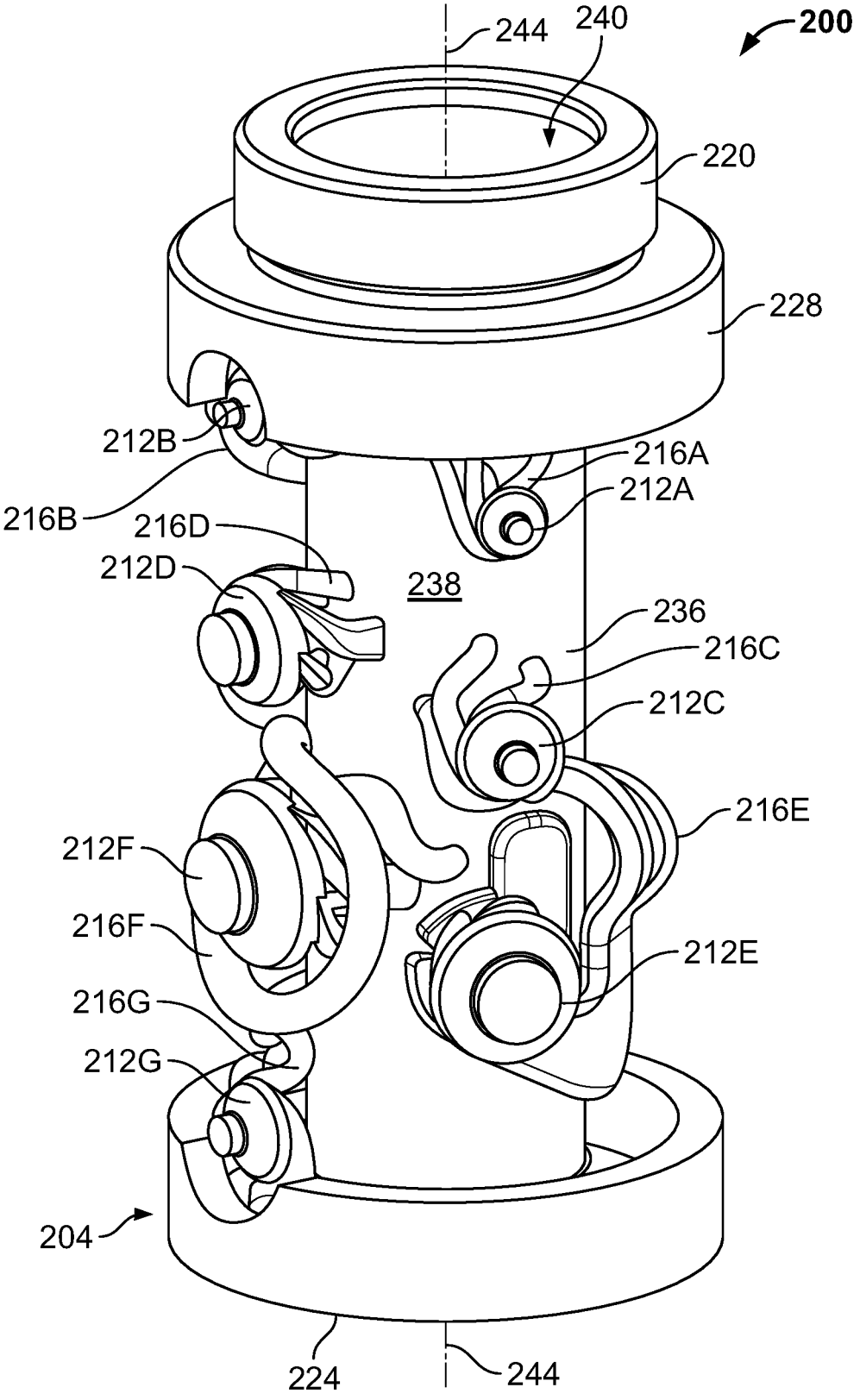
FIG. 4 is another isometric view of the spray head of FIG. 3.

As best shown in FIGS. 3 and 4, the entrance ports 208 are formed in the main body 204, particularly in the inner wall 238, along the central passage 240 (i.e., between the first and second ends 220, 224). The entrance ports 208 are generally circumferentially arranged about the central passage 240 such that the entrance ports 208 are radially spaced from one another and spaced from one another along the longitudinal axis 244, though two or more of the entrance ports 208 may be radially aligned with one another and/or longitudinally aligned with one another. In any case, so formed, the entrance ports 208 are in fluid communication with fluid supplied by the source and flowing through the central passage 240.

Figure 2:
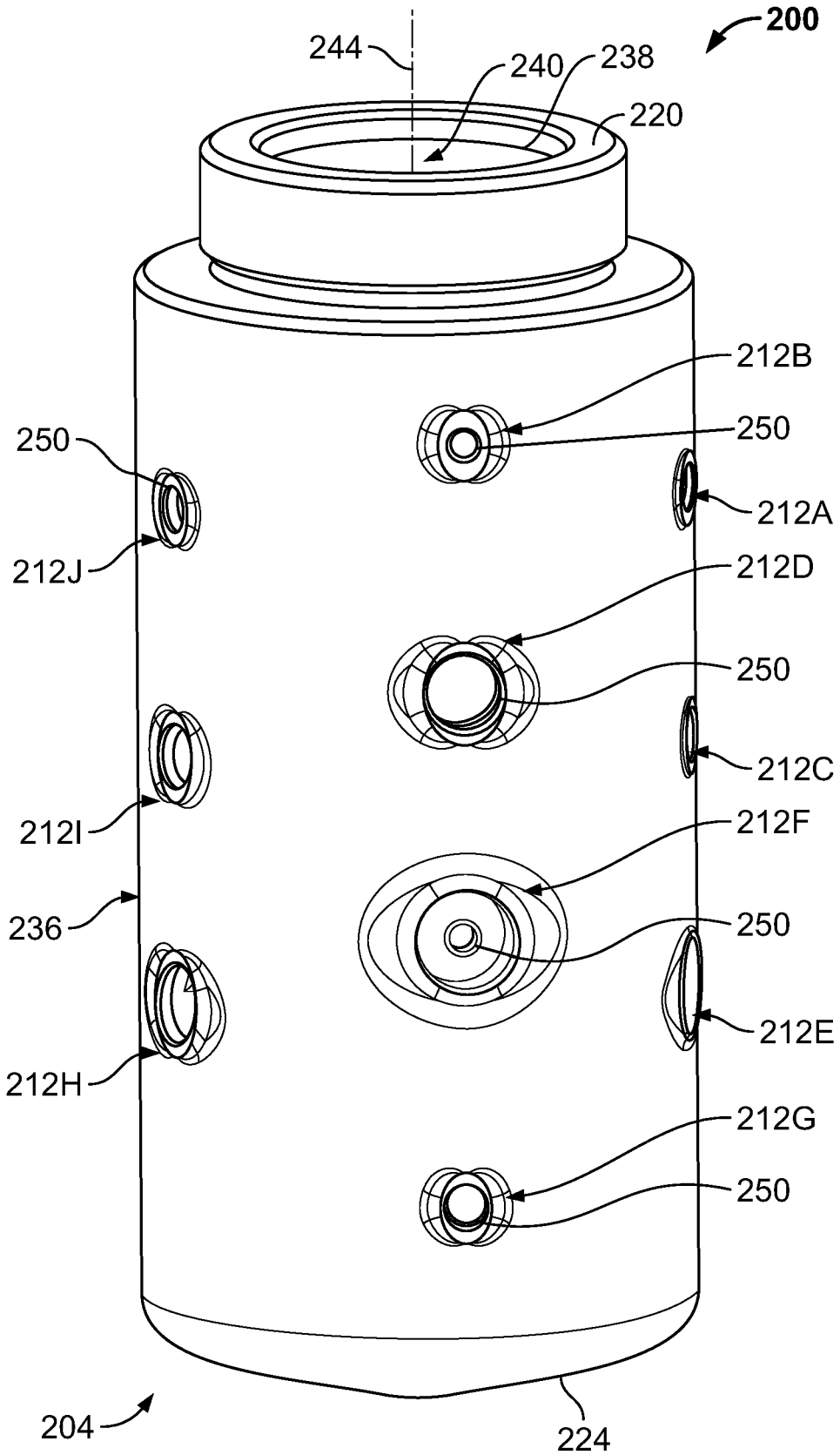
FIG. 2 is an isometric view of an example spray head that is constructed in accordance with the teachings of the present disclosure and can be used in a desuperheater that is coupled to the flow line of FIG. 1.

The spray nozzles 212A-212J are hollow components that are integrally formed in the main body 204 when the spray head 200 is manufactured. As illustrated in FIG. 2, which illustrates the spray nozzles 212A-212J as seen from outside of the spray head 200, and FIGS. 3 and 4, wherein portions of the main body 204 are removed to show the nozzles 212A-212J in outline for illustration purposes, the spray nozzles 212A-212J are generally arranged adjacent the outer wall 237 of the main body 204 between the first and second ends 220, 224. In particular, the spray nozzles 212A-212J are arranged such that a substantial portion of each of the spray nozzles 212A-212J is disposed between the outer and inner walls 237, 238, and the remaining portion of each of the spray nozzles 212A-212J is disposed radially outward of the outer wall 237. In other words, a portion of each of the spray nozzles 212A-212J projects radially outwardly from the outer wall 237 of the main body 204. In other cases, however, one or more of the spray nozzles 212A-212J may be wholly disposed between the outer and inner walls 237, 238. As with the entrance ports 208, the nozzles 212A-212J are generally circumferentially arranged about the central passage 240 such that the spray nozzles 212A-212J are radially spaced from one another and longitudinally spaced from one another (i.e., spaced from one another along the longitudinal axis 244). Thus, as an example, the spray nozzle 212A is radially spaced from the spray nozzle 2126 (i.e., the spray nozzle 212A is rotated about the longitudinal axis 244 relative to the spray nozzle 212B) and the spray nozzle 212A is positioned closer to the second end 224 than the spray nozzle 2126.

Figure 5:
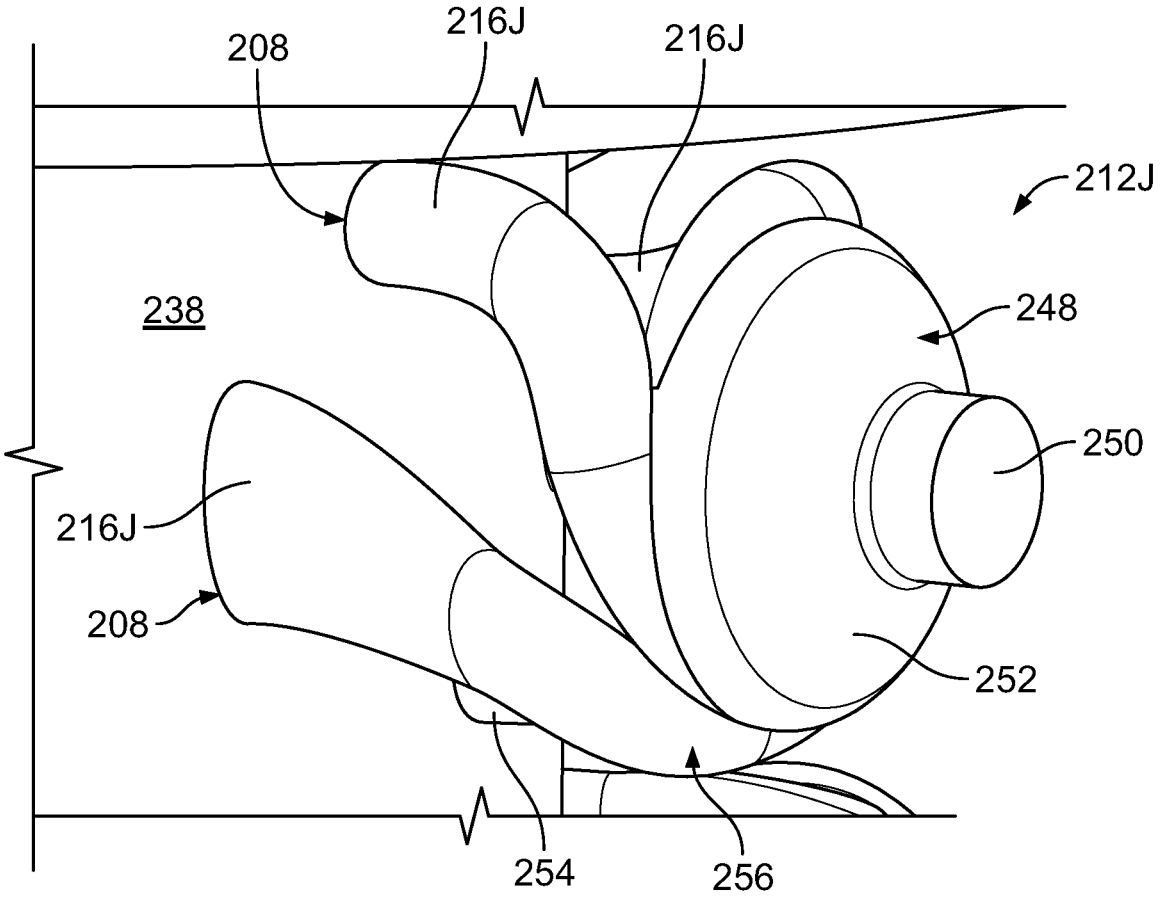
FIG. 5 is a close-up view of a portion of the spray head of FIGS. 3 and 4.

Generally speaking, each of the spray nozzles 212A-212J includes a nozzle body 246, at least one chamber 248 formed in the nozzle body 246, and at least one exit opening 250 that is formed in the nozzle body 246, in fluid communication with the at least one chamber 248, and arranged to provide the fluid supplied by the source to the flow line 102. The nozzle body 246 is integrally formed with the main body 204, such that the nozzle body 246 is not separately viewable in any of FIGS. 2-5. In the spray head 200 illustrated in FIGS. 2-5, each of the spray nozzles 212A-212J includes only one chamber 248, though in other examples, one or more spray nozzles 212A-212J can include more than one chamber 248. As best illustrated in FIG. 5, which depicts the nozzle 212J in greater detail, each chamber 248 preferably takes the form of a swirl chamber that is defined by a conical surface 252 of the nozzle 212J, which causes the fluid flowing through and out of the respective spray nozzle 212A-212J (via the exit opening 250) to swirl (i.e., travel in a helical path), which in turn encourages thorough and uniform mixing between the fluid dispensed by the spray head 200 and the steam flowing through the flow line 102. However, in other examples, one or more of the chambers 248 may be a different type of chamber. As an example, one or more of the chambers 248 may be a cylindrical chamber. In the spray head 200 illustrated in FIGS. 2-5, each of the spray nozzles 212A-212J also includes only one exit opening, though in other examples, one or more of the spray nozzles 212A-212J can include more than one exit opening. Each exit opening 250 preferably has a circular shape in cross-section, though other cross-sectional shapes (e.g., an oval-shape) can be used instead. As best illustrated in FIGS. 2-5, the plurality of flow passages 216A-216J are formed in the nozzle body 246 and provide fluid communication between the entrance ports 208 and the exit opening 250 of the spray nozzles 212A-212J, respectively. In particular, each of the flow passages 216A-216J has (i) an inlet in fluid communication with a respective one of the entrance ports 208, (ii) an outlet that feeds into and is in fluid communication with the at least one chamber 248 of a respective one of the spray nozzles 212A-212J, which is in turn in fluid communication with the at least one exit opening 250 associated with that at least one chamber 248, and (iii) an intermediate portion between the inlet and the outlet. In some cases, multiple flow passages provide fluid communication between the same or different entrance ports 208 and the same exit opening 250 of one of the spray nozzles 212A-212J. As an example, multiple flow passages 216A each independently fluidly connect the same entrance port 208 with the exit opening 250 of the spray nozzle 212A (via the chamber 248 of that spray nozzle 212A), such that fluid independently flows through the spray nozzle 212A via the multiple different flow passages 216A. As such, the spray head 200 need not include a feed chamber, as is included with some known spray heads, thereby reducing the footprint of the spray head 200. In other cases, however, only one flow passage may be used to provide fluid communication between one of the entrance ports 208 and the exit opening 250 of one of the spray nozzles 212A-212J.

Moreover, at least some of the flow passages 216A-216J have a non-uniform, or variable, cross-section as well as different lengths. As illustrated in FIGS. 3 and 5, for example, the flow passages 216J, which each provide fluid communication between respective entrance ports 208 and the exit opening 250 of the spray nozzle 212J, have non-uniform cross-sections and different lengths than one another. For example, one of the flow passages 216J has a first diameter at portion 254 and a second diameter at portion 258 that is larger than the first diameter. In turn, these flow passages 216J affect the pressure of fluid flowing therethrough in different ways. In most cases, these flow passages 216J will reduce the pressure of fluid flowing therethrough at different rates, such that one or more of the flow passages 216J provides fluid to the exit opening 250 of the spray nozzle 212J at a first pressure and one or more of the flow passages 216J provides fluid to the exit opening 250 of the spray nozzle 212J at a second pressure, which is different from the first pressure when the inlet of one or more of the flow passages 216J is partially opened. Additionally, at least some of the flow passages 216A-216J have a component that is parallel to the longitudinal axis 244 and another component that is perpendicular to the longitudinal axis 244, such that different levels of pressure reduction can be achieved, all without adding to the footprint of the spray head 200. Further yet, each of the flow passages 216A-216J follows a non-linear, and, in many cases, a convoluted, path, e.g., a helical or other free-form path. For example, as illustrated in FIGS. 3 and 4, each of the flow passages 216G follows a convoluted path, with the inlet of each of the flow passages positioned at a respective entrance port 208 positioned adjacent to the first end 220 of the main body 204, the intermediate portion extending away from the inlet in a longitudinal direction along the inner wall 238 and in a radial direction along the inner wall 238, before curving radially outward toward the chamber 248 of the spray nozzle 212G and feeding into the outlet positioned adjacent the second end 224 of the main body 204. At the same time, each of the flow passages 216A-216J provides a relatively smooth transition from the outlet to the chamber 248 of the respective spray nozzle.

Figure 6:
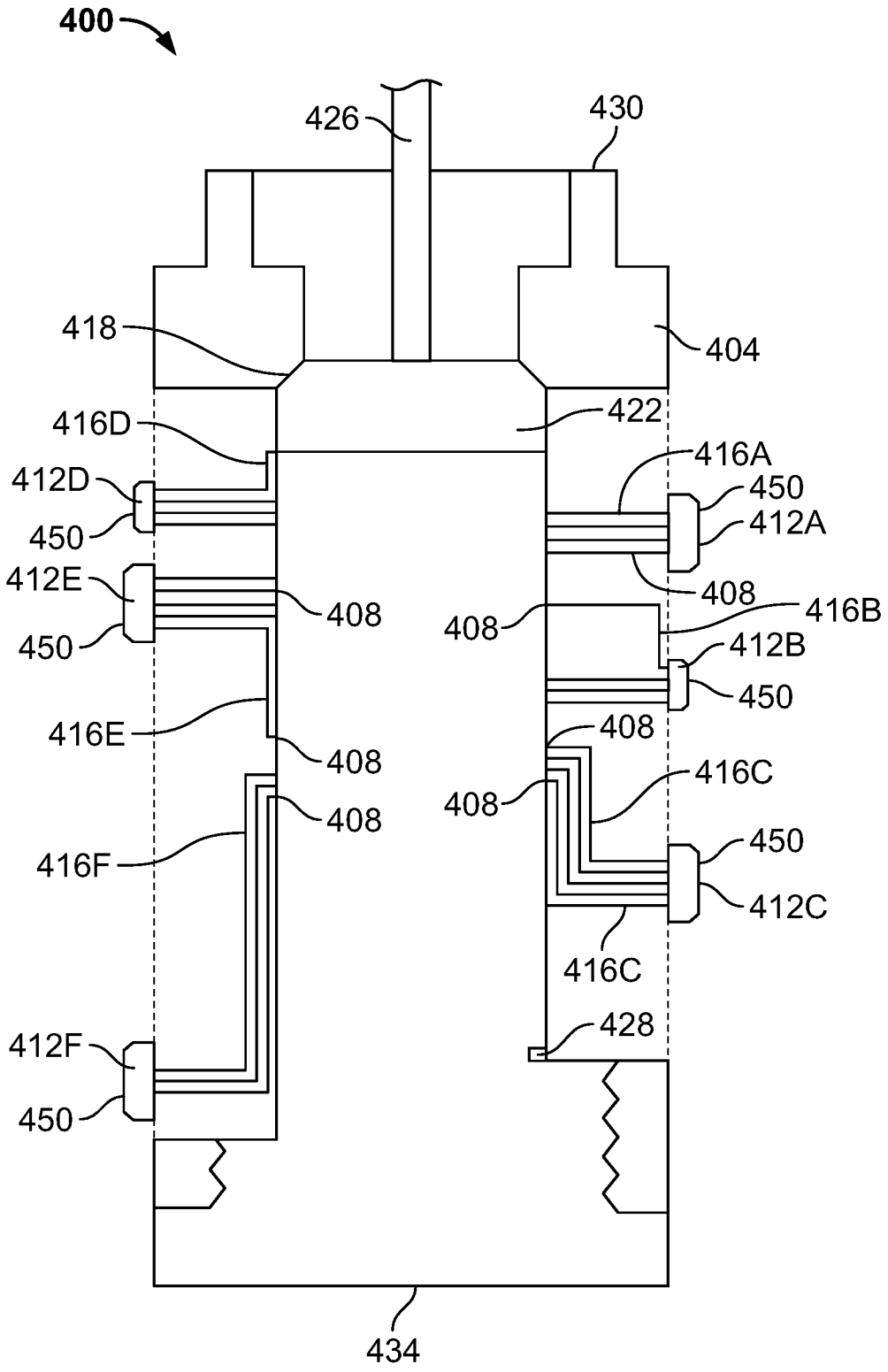
FIG. 6 is a schematic cross-sectional view of another example spray head that is constructed in accordance with the teachings of the present disclosure and can be used in a desuperheater that is coupled to the flow line of FIG. 1.

FIG. 6 illustrates another example of a spray head 400 constructed in accordance with the teachings of the present disclosure. The spray head 400 is similar to the spray head 200, in that the spray head 400 similarly includes a main body 404, a plurality of entrance ports 408 formed in the main body 404, a plurality of spray nozzles 412A-412F formed in the main body 404 and having a plurality of flow passages 416A-416F that provide fluid communication between a respective one of the entrance ports 408 and an exit opening 450 of a respective one of the flow passages 416A-416F, with each of these components integrally formed with one another to form a unitary spray head. However, unlike the spray head 200, the spray head 400 also includes a valve seat 418, a fluid flow control member 422, and a valve stem 426 that operatively couples an actuator (not shown) to the fluid flow control member 422 for controlling the position of the fluid flow control member 422.

The valve seat 418 is generally coupled to the main body 404. In this example, the valve seat 418 is integrally formed within the main body 404 at a position proximate to a first end 430 of the main body 404. In other examples, however, the valve seat 418 can be removably coupled to the main body 404 and/or positioned elsewhere within the main body 404. The fluid flow control member 422, which in this example takes the form of a valve plug, is movably disposed within the main body 404 relative to the valve seat 418 to control the flow of fluid into the spray head 400. In particular, the fluid flow control member 422 is movable between a first position, in which the fluid flow control member 422 sealingly engages the valve seat 418, and a second position, in which the fluid flow control member 422 is spaced from the valve seat 418 and sealingly engages a travel stop 428 positioned in the main body 404. It will be appreciated that in the first position, the fluid flow control member 422 prevents fluid from the source of fluid from flowing into the spray head 400 (via the first end 430), which also serves to prevent the spray nozzles 412A-412F from emitting the fluid into the flow line 102. Conversely, in the second position, the fluid flow control member 422 allows fluid from the source of fluid to flow into the spray head 400, such that the spray nozzles 412A-412F can in turn emit the fluid into the flow line 102.

It will also be appreciated that the spray nozzles 412A-412F are positioned at different locations between the first end 430 of the main body 404 and a second end 434 of the main body 404 opposite the first end 430. As illustrated in FIG. 6, for example, the spray nozzle 412A is positioned closer to the first end 430 than the spray nozzle 412B, and the spray nozzle 412B is positioned closer to the first end 430 than the spray nozzle 412C. As a result of this arrangement, the spray nozzles 412A-412F are exposed (i.e., opened) or blocked (i.e., closed) at different times as the fluid flow control member 422 moves between its first and second positions. In particular, as the fluid flow control member 422 moves from the first position to the second position, exposing the spray nozzle 412D, then exposing the spray nozzle 412A, and so on, the fluid will flow into and out of the spray nozzle 412D (via the flow passages 416D), then into and out of the spray nozzle 412A (via the flow passages 416A), and so on. By exposing (or blocking) the spray nozzles 412A-412F sequentially, one after another, the spray head 400 provides for a better, more consistent distribution of the fluid within the flow line 102 than the fluid distribution provided by known spray heads.

Figure 7:
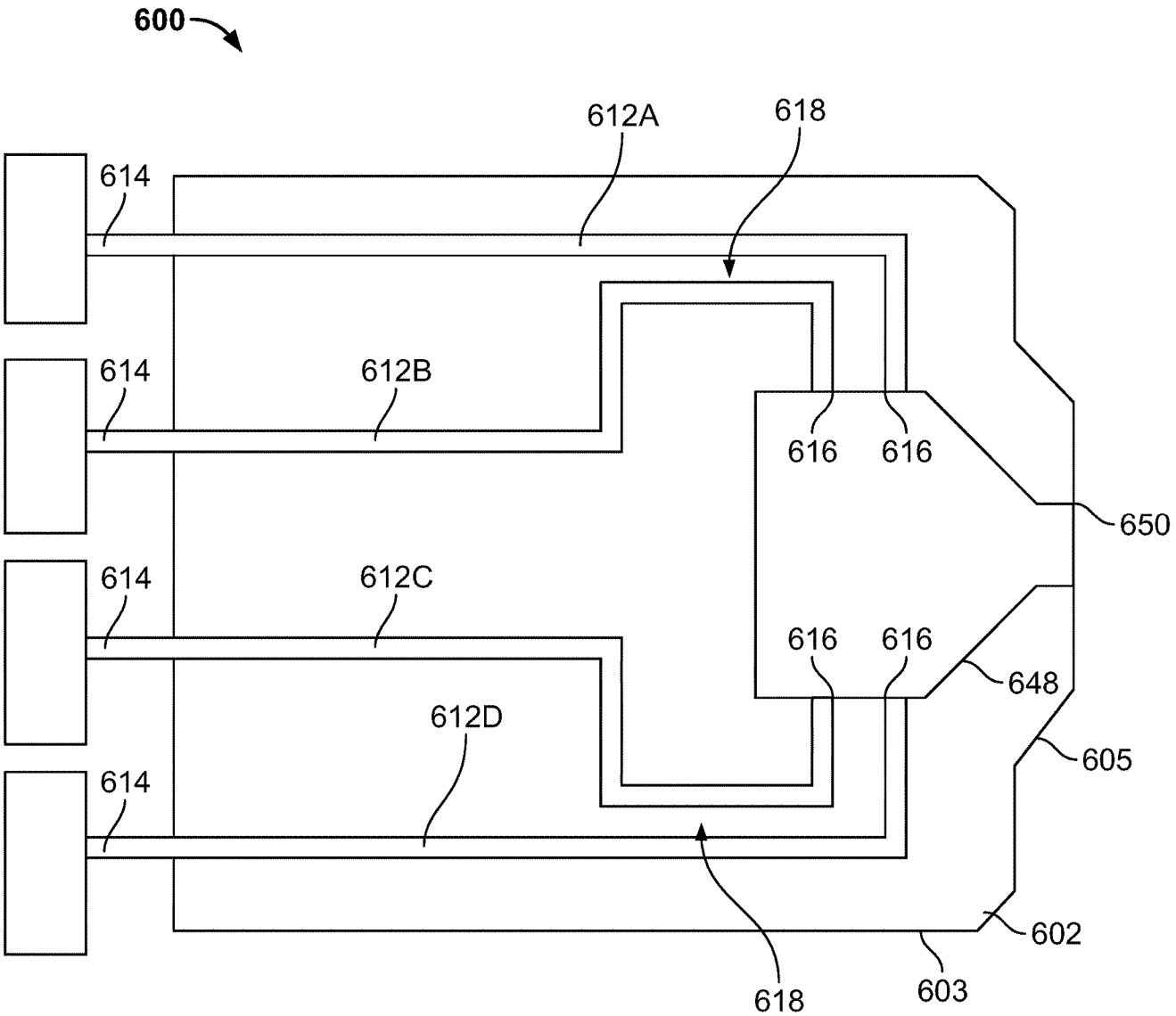
FIG. 7 is a cross-sectional view of another example of a nozzle constructed in accordance with the teachings of the present disclosure.

FIG. 7 illustrates an example of a spray nozzle 600 that is constructed in accordance with the teachings of the present disclosure and may be employed in the spray head 200, the spray head 400, or another spray head. The spray nozzle 600 in this example includes a nozzle body 602, a plurality of flow passages 612A-612D formed in the nozzle body 602, a single chamber 648, similar to the chamber 248, formed in the nozzle body 602, and an exit opening 650 formed in the nozzle body 602. The nozzle body 602 has a substantially cylindrical shape defined by a cylindrical portion 603 and a frustoconical portion 605 extending outward from the cylindrical portion 603. The plurality of flow passages 612A-612D are similar to the flow passages discussed above, in that each of the flow passages 612A-612D follows a non-linear path defined by an inlet 614, an outlet 616, and an intermediate portion 618 disposed between the inlet 614 and the outlet 616. In this example, the inlets 614 are disposed outside of the nozzle body 602, such that the inlets 614 are arranged to be immediately adjacent to and in fluid communication with a respective entrance port. Meanwhile, the outlets 616 are disposed within the nozzle body 602 and immediately adjacent to and in fluid communication with the single chamber 648, which is in turn in fluid communication with the exit opening 650. Thus, each of the flow passages 612A-612D is configured to provide fluid communication between the respective entrance port and the exit opening 650.

As illustrated in FIG. 7, the non-linear path followed by the flow passage 612A has a first distance and the non-linear path followed by the flow passage 6126 has a second distance that is different from the first distance. Thus, the flow passage 612A provides fluid to the chamber 648 at a first pressure and the flow passage 6126 provides fluid to the chamber 648 at a second pressure (which is different from the first pressure when the inlet of the flow passage 6126 is partially opened). Similarly, the non-linear path followed by the flow passage 612C has a third distance and the non-linear path followed by the flow passage 612D has a fourth distance that is different from the third distance. Thus, the flow passage 612C provides fluid to the chamber 648 at a third pressure and the flow passage 612D provides fluid to the chamber 648 at a fourth pressure (the fourth pressure may be different than the third pressure when the inlet of the flow passage 612D is partially opened). The third pressure may be equal to or different than the first and second pressures, depending on whether the flow passages are fully or partially opened. Likewise, the fourth pressure may be equal to or different than the first and second pressures, depending on whether the flow passages are fully or partially opened.

Figure 8:
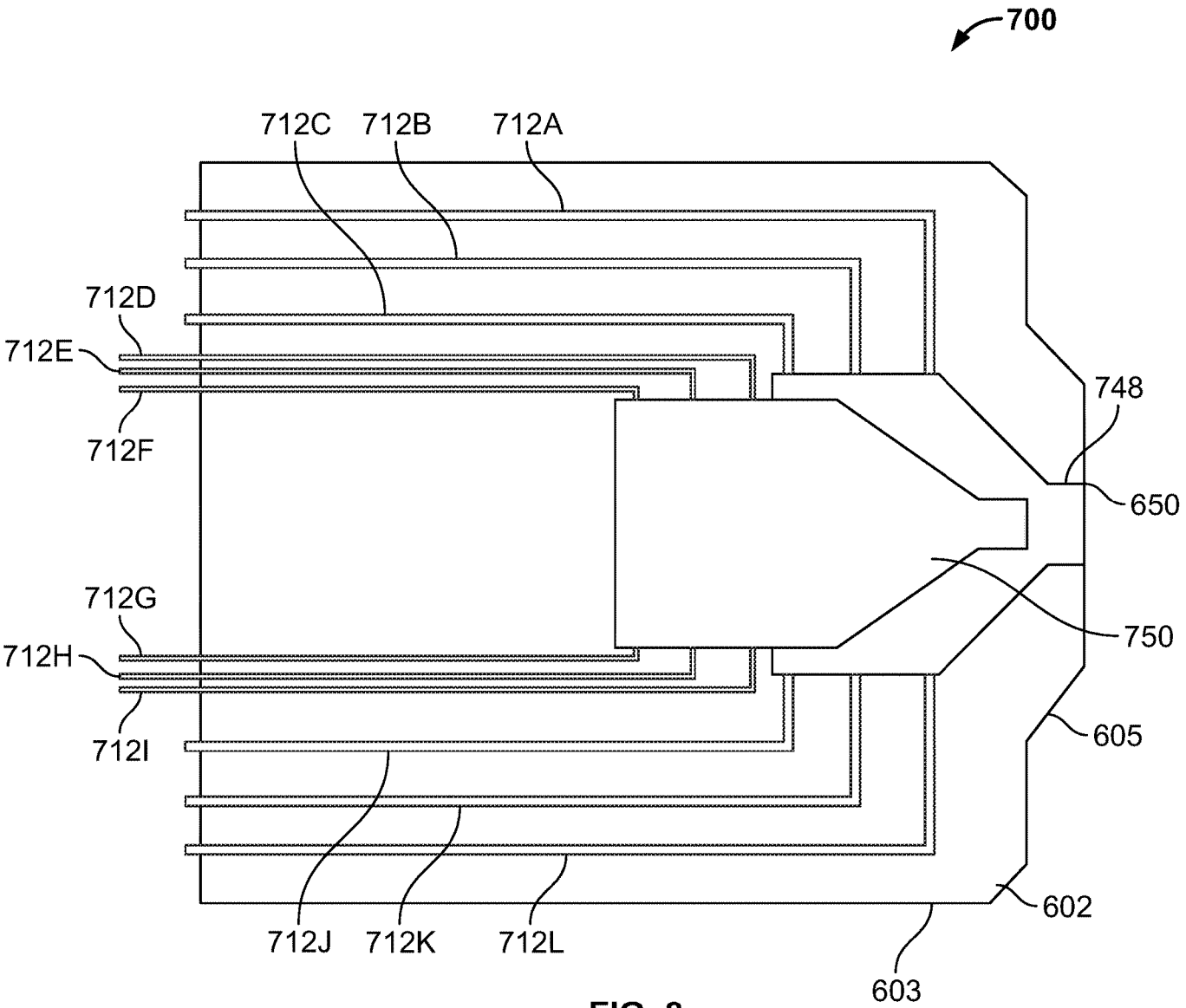
FIG. 8 is a cross-sectional view of yet another example of a nozzle constructed in accordance with the teachings of the present disclosure.

FIG. 8 illustrates another example of a spray nozzle 700 constructed in accordance with the teachings of the present disclosure. The spray nozzle 700 is similar to the spray nozzle 600, with common components depicted using common reference numerals, but is different in several ways. First, the spray nozzle 700 includes additional and differently arranged flow passages 712A-712L, each of which follows a non-linear path. However, as illustrated, the non-linear path followed by the flow passages 712A-712C has a different distance than the non-linear path followed by the flow passages 712D-712F, and the non-linear path followed by the flow passages 712G-712I has a different distance than the non-linear path followed by the flow passages 712J-712L. Second, while each of the flow passages 712A-712L has an inlet that is positioned outside of the nozzle body 602, the inlets of the flow passages 712D-712I terminate at a different position than the inlets of the other flow passages 712A-712C and 712J-712L. More particularly, the inlets of the flow passages 712D-712I are positioned further outward from the nozzle body 600 than the inlets of the other flow passages 712A-712C and 712J-712L. Third, the spray nozzle 700 has two chambers instead of a single chamber (as the spray nozzle 600 has). In particular, the spray nozzle 700 has a first chamber 748 and a second chamber 750 that is distinct from but in fluid communication with the first chamber 748. In this example, the first and second chambers 748, 750 are formed in the nozzle body 602 such that the first and second chambers 748, 750 are co-axial with one another and the second chamber 750 is concentrically arranged within the first chamber 748. In other examples, however, the first and second chambers 748, 750 can be arranged differently. As an example, the second chamber 750 need not be concentrically arranged within the first chamber 748. The first chamber 748 is similar to the chamber 648, in that the first chamber 748 terminates at and is in fluid communication with the exit opening 650. The first chamber 748 is also fluidly connected to the outlets of flow passages 712A-712C and 712J-712L, such that fluid flowing through these flow passages is directed to the first chamber 748 and, ultimately, the exit opening 650. Meanwhile, the second chamber 750 is fluidly connected to the outlets of flow passages 712D-712I, such that fluid flowing through these flow passages is directed to the second chamber 750, then the first chamber 748, and finally the exit opening 650.

Figure 9:
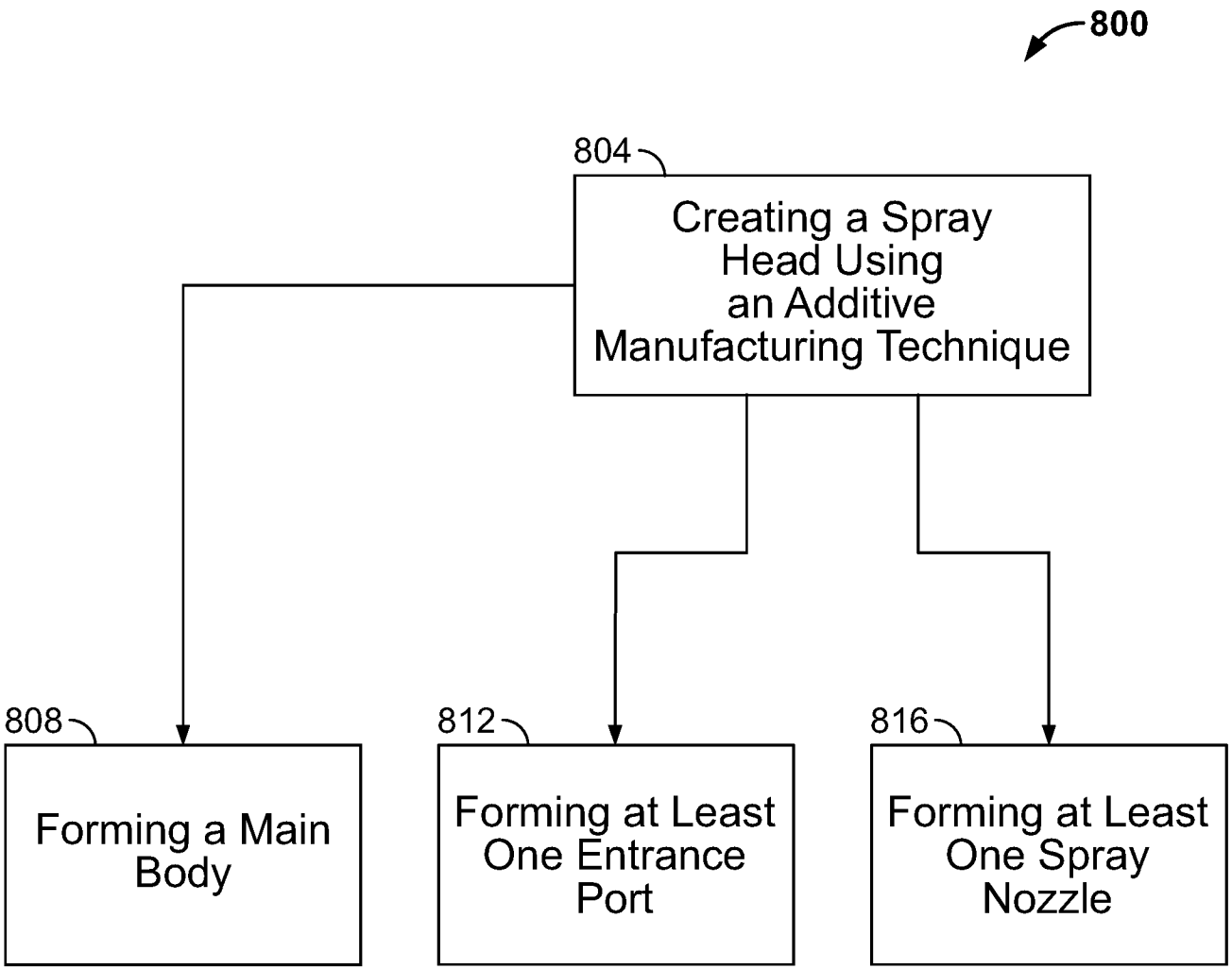
FIG. 9 is a flow diagram depicting an example of a method for manufacturing spray heads according to the teachings of the present disclosure.

FIG. 9 is a flow diagram depicting an example method 800 for manufacturing a spray head (e.g., the spray head 200, the spray head 400) in accordance with the teachings of the present disclosure. In this example, the method 800 includes creating the spray head for a desuperheater (e.g., the desuperheater 104) using an additive manufacturing technique (block 804). The act of creating the spray head includes, in no particular order, (1) forming a main body (e.g., the main body 204) of the spray head having an exterior surface (e.g., the outer wall 237) and defining a central passage (e.g., the passage 240) that extends along a longitudinal axis (e.g., the longitudinal axis 244), the main body adapted for connection to a source of fluid (block 808), (2) forming at least one entrance port (e.g., entrance port 208) in the main body along the central passage (block 812), (3) forming at least one spray nozzle (e.g., spray nozzles 212A-212J) arranged adjacent the exterior surface of the main body (block 816), the spray nozzle having at least one exit opening (e.g., exit opening 250) and a plurality of flow passages (e.g., flow passages 216A-216J) that provide fluid communication between the entrance port and the exit opening of the spray nozzle, wherein a first one of the plurality of flow passages follows a first non-linear path and has a first distance, and wherein a second one of the plurality of flow passages follows a second non-linear path and has a second distance that is different than the first distance. As used herein, the term additive manufacturing technique refers to any additive manufacturing technique or process that builds three-dimensional objects by adding successive layers of material on a material (e.g., a build platform). The additive manufacturing technique may be performed by any suitable machine or combination of machines. The additive manufacturing technique may typically involve or use a computer, three-dimensional modeling software (e.g., Computer Aided Design, or CAD, software), machine equipment, and layering material. Once a CAD model is produced, the machine equipment may read in data from the CAD file (e.g., a build file) and layer or add successive layers of liquid, powder, sheet material (for example) in a layer-upon-layer fashion to fabricate a three-dimensional object. The additive manufacturing technique may include any of several techniques or processes, such as, for example, a stereolithography ("SLA") process, a fused deposition modeling ("FDM") process, multi-jet modeling ("MJM") process, a selective laser sintering or selective laser melting process ("SLS" or "SLM", respectively), an electronic beam additive manufacturing process, and an arc welding additive manufacturing process. In some embodiments, the additive manufacturing process may include a directed energy laser deposition process. Such a directed energy laser deposition process may be performed by a multi-axis computer-numerically-controlled ("CNC") lathe with directed energy laser deposition capabilities.

Further, while several examples have been disclosed herein, any features from any examples may be combined with or replaced by other features from other examples. Moreover, while several examples have been disclosed herein, changes may be made to the disclosed examples without departing from the scope of the claims.

What is claimed is:

1. A spray head for a desuperheater, comprising:

a main body having an exterior surface and an inner wall that is disposed radially inwardly of the exterior surface and defines a central passage that extends axially along a longitudinal axis, the main body adapted for connection to a source of fluid;

at least one entrance port formed in the inner wall of the main body along the central passage;

at least one spray nozzle arranged adjacent the exterior surface of the main body, the spray nozzle having at least one exit opening and a plurality of flow passages, each of the plurality of flow passages providing fluid communication between the entrance port and the exit opening of the spray nozzle, wherein a first one of the plurality of flow passages follows a first non-linear path and has a first distance, and wherein a second one of the plurality of flow passages follows a second non-linear path and has a second distance different from the first distance, wherein the at least one spray nozzle is arranged radially outwardly of the at least one entrance port.

2. The spray head of claim 1, wherein the first non-linear path comprises a first convoluted path and wherein the second non-linear path comprises a second convoluted path.

3. The spray head of claim 1, wherein the first flow passage has a first variable cross-section and the second flow passage has a second variable cross-section.

4. The spray head of claim 1, wherein the fluid exiting the exit opening via the first flow passage has a first pressure, and the fluid exiting the exit opening via the second flow passage has a second pressure that differs from the first pressure when an inlet of the second flow passage is not fully open.

5. The spray head of claim 1, wherein the main body and the spray nozzle are integrally formed with one another.

6. The spray head of claim 1, wherein the spray nozzle includes a single chamber disposed between and fluidly connecting each of the flow passages and the exit opening of the spray nozzle.

7. The spray head of claim 6, wherein each of the flow passages has an outlet that feeds into the single chamber, such that the flow passages are independently coupled to the single chamber.

8. The spray head of claim 1, wherein the first flow passage has a portion that is parallel to the longitudinal axis of the body.

9. The spray head of claim 1, wherein the entrance port is positioned adjacent a first end of the main body, the first flow passage has an inlet in fluid communication with the entrance port, and an outlet in fluid communication with the exit opening of the spray nozzle, the outlet positioned adjacent a second end of the main body.

10. The spray head of claim 1, wherein the spray nozzle includes a first chamber and a second chamber, wherein the first chamber is disposed between and fluidly connects the first flow passage and the exit opening of the spray nozzle, and wherein the second chamber is disposed between and fluidly connects the second flow passage and the exit opening of the spray nozzle.

11. The spray head of claim 10, wherein the first and second chambers are concentrically arranged.

12. The spray head of claim 1, wherein the first flow passage has a first inlet that fluidly connects the entrance port with the exit opening, and wherein the second flow passage has a second inlet that fluidly connects the entrance port with the exit opening, the second inlet being separate from the first inlet.

13. The spray head of claim 1, wherein a first portion of the spray nozzle is disposed between the inner wall and the exterior surface, and a second portion of the spray nozzle projects radially outwardly from the exterior surface.

14. A desuperheater, comprising:

a desuperheater body; and a spray head coupled to the desuperheater body, the spray head comprising:

a main body having an exterior surface and an inner wall defining a central passage that extends along a longitudinal axis, the main body adapted for connection to a source of fluid;

at least one entrance port formed in the inner wall of the main body along the central passage; and a plurality of spray nozzles arranged adjacent the exterior surface of the main body, each spray nozzle having at least one exit opening and a plurality of flow passages, each of the plurality of flow passages providing fluid communication between the entrance port and the exit opening of the respective spray nozzle, wherein a first one of the plurality of flow passages follows a first non-linear path and has a first distance, and wherein a second one of the plurality of flow passages follows a second non-linear path and has a second distance different from the first distance.

15. The desuperheater of claim 14, wherein the spray head comprises first and second entrance ports, wherein the first entrance port is spaced from the second entrance port along the longitudinal axis.

16. The desuperheater of claim 14, further comprising a plug movably disposed within the main body of the spray head to control fluid flow through the entrance port and out of the spray head.

17. The desuperheater of claim 14, wherein the first flow passage has a first variable cross-section and the second flow passage has a second variable cross-section, such that the fluid exiting the exit opening via the first flow passage has a first pressure, and the fluid exiting the exit opening via the second flow passage has a second pressure that differs from the first pressure when an inlet of the second flow passage is not fully open.

18. The desuperheater of claim 14, wherein each spray nozzle includes a single chamber disposed between and fluidly connecting each of the flow passages and the exit opening of the respective spray nozzle, wherein each of the flow passages has an outlet that feeds into the single chamber, such that the flow passages are independently coupled to the single chamber.

19. The desuperheater of claim 14, wherein each spray nozzle includes a first chamber and a second chamber, wherein the first chamber is disposed between and fluidly connects the first flow passage and the exit opening of the respective spray nozzle, and wherein the second chamber is disposed between and fluidly connects the second flow passage and the exit opening of the respective spray nozzle.

20. The desuperheater of claim 19, wherein the first and second chambers are concentrically arranged.

21. The desuperheater of claim 14, wherein the first flow passage has a first inlet that fluidly connects the entrance port with the exit opening, and wherein the second flow passage has a second inlet that fluidly connects the entrance port with the exit opening, the second inlet being separate from the first inlet.

22. A method of manufacturing, comprising:

creating a spray head for a desuperheater using an additive manufacturing technique, the creating comprising:

forming a main body of the spray head having an exterior surface and an inner wall that is disposed radially inwardly of the exterior surface and defines a central passage that extends axially along a longitudinal axis, the main body adapted for connection to a source of fluid;

forming at least one entrance port in the inner wall of the main body along the central passage;

forming at least one spray nozzle arranged adjacent the exterior surface of the main body, the spray nozzle having at least one exit opening and forming a plurality of flow passages that provide fluid communication between the entrance port and the exit opening of the spray nozzle, wherein a first one of the plurality of flow passages follows a first non-linear path and has a first distance, and wherein a second one of the plurality of flow passages follows a second non-linear path and has a second distance different from the first distance, wherein the at least one spray nozzle is arranged radially outwardly of the at least one entrance port.

* * * * *